US005398346A

United States Patent [19]

Feinberg et al.

[11] Patent Number: 5,398,346

[45] Date of Patent: Mar. 21, 1995

[54] PANTY UNDERGARMENT WITH STRETCH PANELS

[75] Inventors: Herbert Feinberg, New York, N.Y.; Norman Katz, Jackson, Tenn.; Denise Bro, New York, N.Y.

[73] Assignee: I. Appel Corporation, New York, N.Y.

[21] Appl. No.: 111,780

[22] Filed: Aug. 25, 1993

Related U.S. Application Data

[63] Continuation of Ser. No. 918,583, Jul. 22, 1992, abandoned.

[51] Int. Cl.[6] ..... A41B 9/04

[52] U.S. Cl. ..... 2/400; 2/406; 66/177

[58] Field of Search ..... 2/400, 401, 402, 406, 2/78 B, 403, 406, 78.3; 66/176, 177

[56] References Cited

U.S. PATENT DOCUMENTS

| | | | |
|---|---|---|---|
| 2,687,525 | 8/1954 | Rutledge | 66/176 |
| 2,717,388 | 9/1955 | Rutledge | 2/401 |
| 2,792,698 | 5/1957 | Hampp | 2/401 |
| 3,344,438 | 10/1967 | Title | 2/406 |
| 3,486,507 | 12/1969 | Bregenzer et al. | 2/401 |
| 3,491,763 | 1/1970 | Osterman et al. | 2/406 |
| 3,591,865 | 11/1971 | Senser | 2/402 |
| 4,341,095 | 7/1982 | Poteat | 2/402 |
| 4,682,479 | 7/1987 | Pernick | 66/176 |
| 4,887,439 | 12/1989 | Tenconi | 66/176 |
| 5,163,306 | 11/1992 | Boehm et al. | 66/177 |

FOREIGN PATENT DOCUMENTS

| | | | |
|---|---|---|---|
| 954813 | 4/1964 | United Kingdom | 2/406 |
| 1604558 | 12/1981 | United Kingdom | 2/402 |

*Primary Examiner*—Andrew M. Falik
*Assistant Examiner*—Amy B. Vanatta
*Attorney, Agent, or Firm*—Abelman, Frayne & Schwab

[57] ABSTRACT

A panty garment has a single seam in its construction, which is positioned at the gluteal crease of the wearer and is devoid of any seams at the frontal portion thereof. The panty garment is stretchable in a longitudinal direction, a transverse direction, and a bias direction, with the stretch in the transverse and bias directions being greater than the stretch in the longitudinal direction.

4 Claims, 2 Drawing Sheets

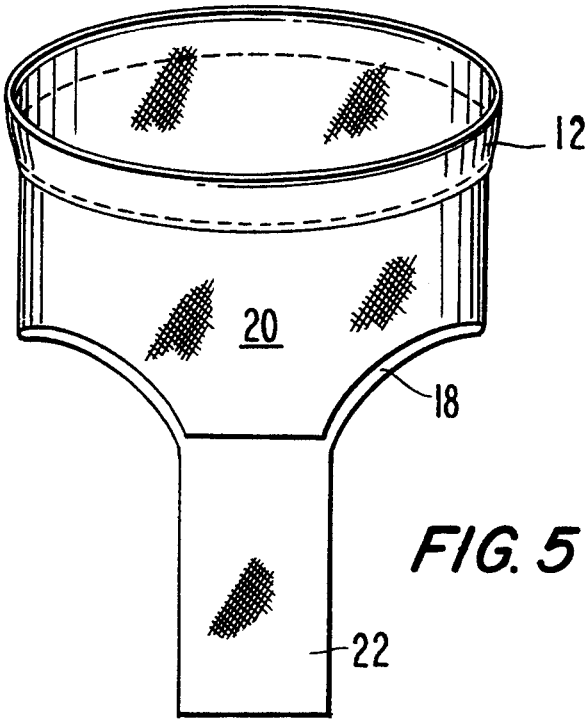
FIG. 5
FIG. 7
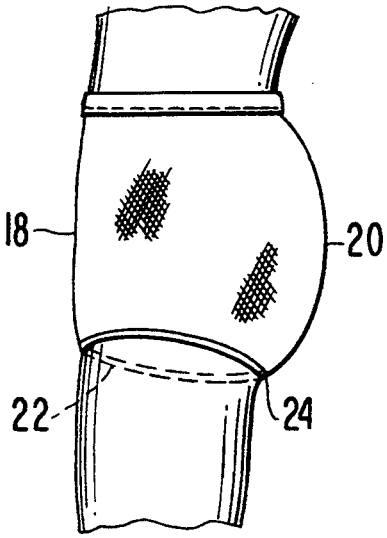
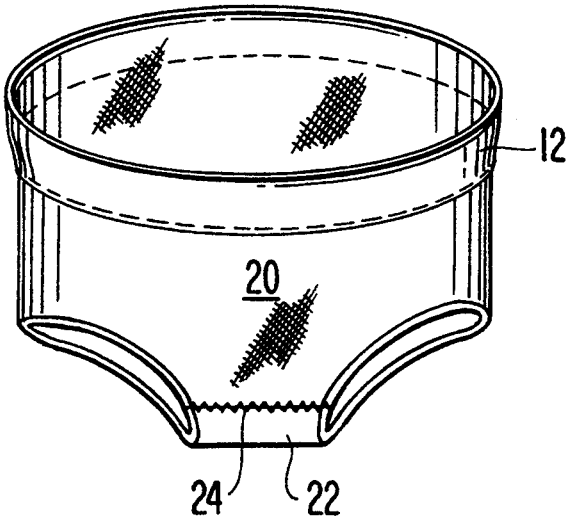
FIG. 6

PANTY UNDERGARMENT WITH STRETCH PANELS

This application is a continuation of application Ser. No. 07/918,583, filed Jul. 22, 1992, now abandoned.

FIELD OF THE INVENTION

This invention relates to a panty undergarment that can provide enhanced comfort to the wearer, as compared with known panty garments.

BACKGROUND OF THE INVENTION

Since the conception of garments such as panty undergarments, continuing efforts have been made to enhance the stability of the garment on the wearer's body during movements of the wearer's body such as standing, sitting, walking or running, and, bending movements of the wearer's body.

Dominantly, such efforts have been directed to and have been successful in their objective of minimizing riding-up of the garment, or lateral twisting of the garment, or ruckling and puckering of the garment fabric, and, rolling-over of the garment waistband.

While such efforts have had the desirable result of enhancing the garment stability on the body of the wearer, those efforts also have resulted in increased discomfort to the wearer caused by the garment. For example, control of movement of the garment commonly has been effected by increasing the resistance to stretch of the garment fabric in certain directions, including the incorporation of reinforcements and rigidifying panels into the undergarment. Such reinforcements, in addition to causing an increase in discomfort to the wearer of the garment, commonly result in an increase in the manufacturing cost of the garment, particularly in the event that reinforcing panels are to be appliqued onto or sewn into the garment. In that event, the joins between the garment and the respective panels constitute a further source of discomfort to the wearer of the garment.

Attempts to control riding-up of the crotch of the garment invariably have had the opposite effect of promoting ride-down of the body of the garment, particularly at the waistband.

Typically, attempts to control riding-up of the garment have involved increasing the resistance to stretch the garment in the medial plane that includes the crotch of the garment, such attempts resulting in tensioning of the crotch and its tendency to ride up into the crotch area.

This particular problem is specific to a panty garment, and does not arise, for example, in panty hose. In a panty hose, the leg portions of the garment act to stress the panty section in a downwards direction, thus to provide a counteracting force that stabilizes the crotch against crotch ride-up.

Attempts to control lateral twisting invariably have resorted to reinforcing panels and/or to side seaming to provide a separation zone between the front and rear panels or sections of the garment. Reinforcing panels while being partially successful in controlling lateral twisting of the garment on the wearer's body, are faced with the problem that if unintended relative movement between the garment and the wearer's body does occur, then, the ultimate result is a reverse twisting of the garment on the wearer's body.

Riding down of the garment at the waistband typically produces ruckling or puckering of the body of the undergarment, which then presents an unsightly appearance in the wearer's overgarment, ruckling of the undergarment tending to show through the wearer's overgarment during movements of the wearer's body.

Further, stretching movements of the wearer's body and the subsequent relaxation thereof, and bending movements of the wearer's body have the tendency to cause rolling-over of the waistband of the garment. In attempts to control such rolling over of the waistband, woven elastic material having appreciable lateral stability has been employed, as has the incorporation into the waistband of stays formed from a relatively rigid and inflexible material. The use of woven elastic constitutes a source of discomfort to the wearer of the garment in that it can press into the wearer's flesh leaving unsightly trench marks. The incorporation of stays into the waistband similarly can cause discomfort to the wearer of the garment, particularly during bending movements of the wearer's body.

Optimally, and in direct opposition to the known efforts to control the movement of the garment relative to the wearer's body, the garment should possess the same characteristics of stretchability and contraction as that of the wearer's skin. If the garment is free to move in unison with movements of the wearer's skin, then, the garment in effect becomes a second skin which has full freedom of movement and which obviates relative movement between the garment and the user's skin. If that relationship can be preserved, then, the resulting undergarment can be expected to be one which provides an unexpected degree of comfort in the wearing thereof with a complete freedom from chafing and trenching such as is commonly caused by the undergarments of the prior art.

It is known in the art, for example, from Pernick U.S. Pat. No. 4,682,479 issued Jul. 28th, 1987, to form a panty garment on a circular knitting machine in such a manner that side seams are eliminated. In addition Pernick teaches the providing of a welted waistband, the leading edge of which subsequently is knitted into a succeeding course of the garment blank. It is also known from Pernick U.S. Pat. No. 4,682,479 to knit crotch portions of the garment integrally with the body portion thereof, the crotch of the garment subsequently being assembled by stitching together of the crotch portions.

Pernick's teachings, thus, result in both frontal and posterior seaming of the crotch portion, the frontal seaming of the crotch being one which is most likely to cause irritation and discomfort to the wearer.

SUMMARY OF THE INVENTION

As contrasted with Pernick's teachings of dual crotch portions that are knit integrally with the main body portion of the undergarment, this invention provides a single crotch portion which forms a continuation of a frontal portion of the garment body, the frontal portion of the garment body being intended to overlie the wearer's abdomen. The crotch portion is then attached at its end remote from the frontal portion of the garment body to the lower rear portion of the garment body, the rear portion being intended to overlie the wearer's buttocks. The attachment is by a line of stitching or knitting that is located in the general location of the wearer's gluteal crease.

The provision of a crotch portion that is comprised of a single thickness of fabric has the beneficial result of maintaining longitudinal stretch in the crotch portion substantially the same as the longitudinal stretch in the frontal and posterior body portions, and, maintains lateral and bias stretch in the crotch closely comparable with the lateral and bias stretch in the respective body portions.

Thus, in a manner in no way envisioned in the prior art, and, in direct opposition to prior art teachings, the present invention has for its object to maintain each portion of the panty garment of closely comparable stretchability in the longitudinal direction, to maintain each portion of the panty garment of closely comparable stretchability in lateral directions, and also, to maintain each portion fo the panty undergarment of closely comparable stretchability in bias directions, the location of the single line of stitching being positioned in the location of the gluteal crease of the wearer's body, in which position it presents minimum discomfort to the wearer of the garment without regard to whether the wearer is standing, walking, or sitting.

The construction of Pernick, due to the double thickness of the crotch, requires an excessive amount of yarn to be consumed in the formation of the garment blank.

The garment of the present invention also requires more yarn in the crotch portion than that of a conventional blank for a panty garment, the amount of yarn consumed being somewhere intermediate that of a conventional panty garment and that of the Pernick construction.

However, and contrary to the prior art teachings, it is this additional yarn and the longer length of the crotch portion that provides added stretch in the longitudinal direction of the fabric, that longitudinal stretch being comparable to the longitudinal stretch in the body portions of the garment.

The prior art "short crotch construction" has only limited stretch in the longitudinal direction, which in turn causes riding down of the garment, or, in the alternative, riding up of the crotch portion.

The teachings of Pernick in no way overcome this problem due to the need for dual transverse lines of stitching in the blank garment, together with dual lines of longitudinal stitching at the edges of the leg holes of the garment, which effectively inhibits longitudinal stretch in the crotch portion, and which, in turn, further exacerbates the problems of riding down of the garment, and, riding-up of the crotch portion, both of which conditions are believed to be major contributors to wearer discomfort in known garments.

In comparison with known panty garments, the crotch portion of the present invention, closely approximates the stretch and contraction movements of the human skin during bending movements from standing to sitting or, from sitting to standing, and also closely approximates the longitudinal stretch in the body of the garment.

DESCRIPTION OF THE DRAWINGS

The invention will now be described with reference to the accompanying drawings which illustrate a preferred embodiment of the invention, and, in which:

FIG. 5 is a posterior view of the garment blank prior to assembly of the garment;

FIG. 6 is a posterior view of the assembled garment according to the present invention; and FIG. 7 is a diagrammatic view showing the garment in the orientation it adopts when placed on the body of a wearer.

DESCRIPTION OF THE DRAWINGS

Figure 1:
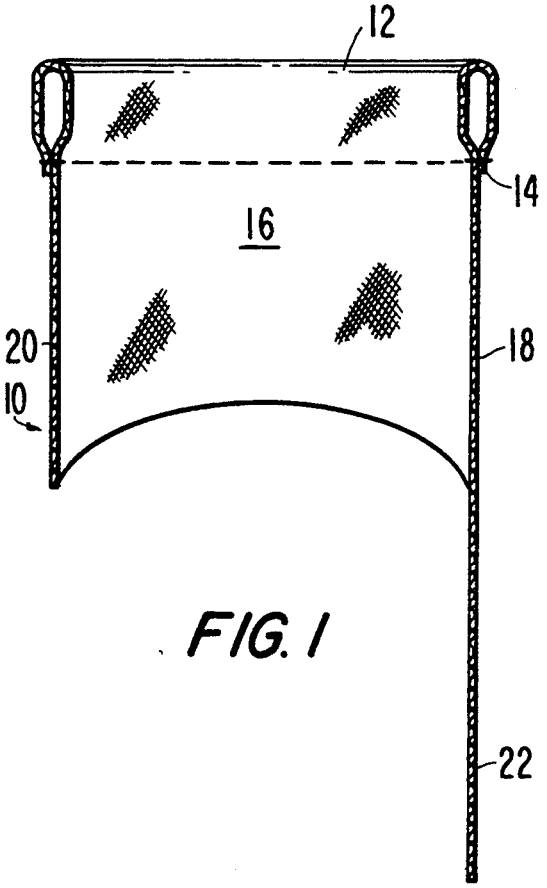
FIG. 1 is a transverse cross-section through a blank for forming into the undergarment of the invention.
Figure 2:
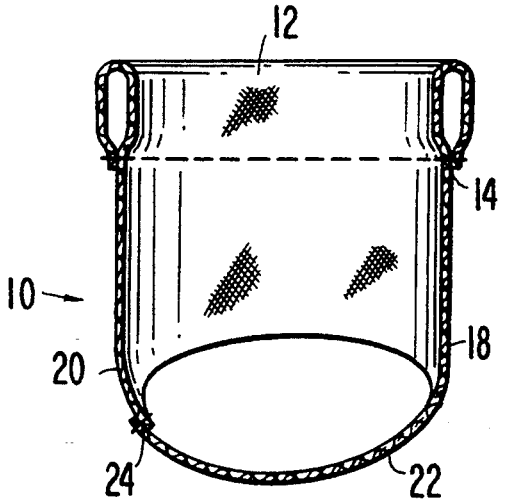
FIG. 2 is a transverse cross-section through an assembled garment according to the present invention.

As is shown in FIGS. 1 and 2, the knitted garment blank is indicated generally at 10, and commences with a knitted waistband 12 of welted form, the commencing course of the welt having been knitted into the body of the garment at 14, in a manner which is entirely well-known in the hosiery trade, and also, in the circular knitting industry.

The waistband 12 is formed as an elastic jersey knit of multiple yarns having characteristics that are complementary to one another. For example, the base yarns can be of cotton fibers that have been twisted into a yarn, or, they can be fibers or filamentary yarns formed from synthetic plastics materials, such yarns imparting a pleasurable hand and feel to the waistband. The base yarns are inter-knitted with yarns of continuous elastic filaments, preferably crenelated plastic filaments having elastic heat settable properties, such as filaments available under the trademarks LYCRA and SPANDEX.

Those elastic yarns are interknit within the jersey knit of the base yarns in a stitch pattern that exhibits maximum elasticity, thus preserving the ability of the jersey knit to stretch by the greatest amount in directions lateral to the direction of knitting, and, for the waistband to have minimal stretch in the direction of knitting. This provides controlled tri-directional stretchability in the waistband in which the substantially planar integrity of the waistband is preserved to mitigate against rolling over, while at the same time, permitting elastic elongation of the waistband, and, lateral shifting of the stitches relative to each other in order that the waistband itself can move in unison with movements of the wearer's skin.

The final course of the welted waistband 12 is continued in the circular knitting process into a body portion 16 providing a first or frontal portion 18 intended to overlie the abdomen of the wearer, and a second or posterior portion 20 intended to overlie the buttocks of the wearer.

The body portion 16 can be knit in any known manner, including jersey knit, and patterned knits, including conventional lace knits, as is well known in the knitting industry.

The body 16 of the garment is comprised of any suitable combination of yarns, that will provide the required hand and feel of the finished fabric, the body of the garment, similarly to that of the waistband, incorporating knitted-in elastically stretchable yarns. As in the waistband, stretchability in the longitudinal direction of knitting is less than that in the transverse and bias directions, and stretchability in the transverse direction is less than stretchability in the bias directions, again to preserve the ability of the garment to move in unison with movements of the wearer's skin.

The first or frontal portion 18 is then continued in the knitting process into an elongate crotch portion 22. The posterior portion 20 is devoid of any downwards extension, and, extends downwardly only a sufficient distance for its lower edge to be substantially in alignment with the wearer's gluteal crease.

The crotch portion 22 can be knit of exactly the same yarns as those employed in the body portion, but preferably includes additional or alternative yarns, in order to provide a terry-cloth surface on the interior of the garment, this typically being provided for by laying in or overfeeding of the cotton yarn or the like. The feeding of the elastic yarns is continued during the knitting of the crotch portion 22, in order that, as in the body of the garment, the crotch portion itself has less stretch in the direction of knitting, and has greater stretch in directions transverse thereto, the stretch in the transverse direction being less than the stretch in the bias directions, thus, again, to provide for movement of the crotch portion in unison with movements of the wearer's skin.

After having completed knitting of the blank of FIG. 1, the blank is then trimmed to remove any floats, subsequent to which the free end of the crotch portion 22 subsequent to which the free end of the crotch portion 22 is turned into alignment with the lower edge of the posterior panel 20, and, is joined into the posterior panel 20 by a knitting process at the location 24.

The garment blank is proportioned during the knitting operation such that the line of stitching 24, during wearing of the garment by a person of usual proportions to which the garment has been sized, lies closely approximate to the plane of the wearer's gluteal crease. In that location, not only does the line of sewing become positioned at a location in which it will not show through the wearer's overgarments, but also, the line of stitching will be in a location that is removed from the wearer's buttocks, thus to eliminate irritation to the wearer of the garment when seated.

As is well known in the industry, various post-assembly finishing operations can then be effected on the garment, in order to size the garment, and set a memory of the intended size of the garment. Such finishing processes commonly include steaming of the garment while it is on a panty form in order to shrink and set the elastic memory of the elastic yarns, and, the washing of the garment in selected baths of finishing compounds to impart lustre to the garment and further enhance the hand and feel of the garment at the point of sale.

Figure 3:
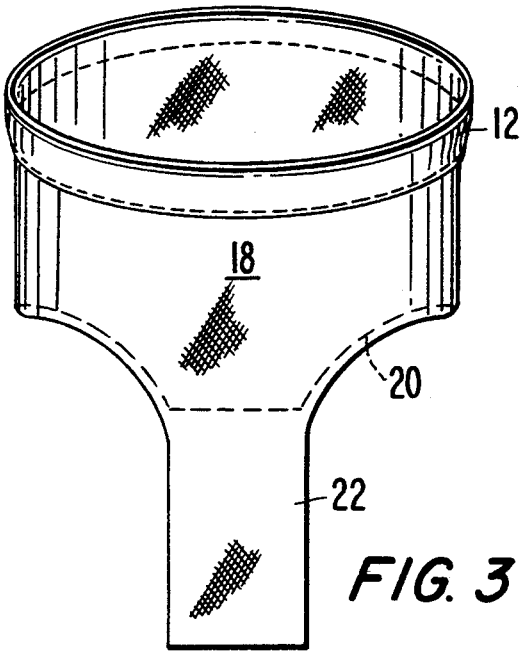
FIG. 3 is a frontal view of the garment blank of the invention prior to assembly of the garment.
Figure 4:
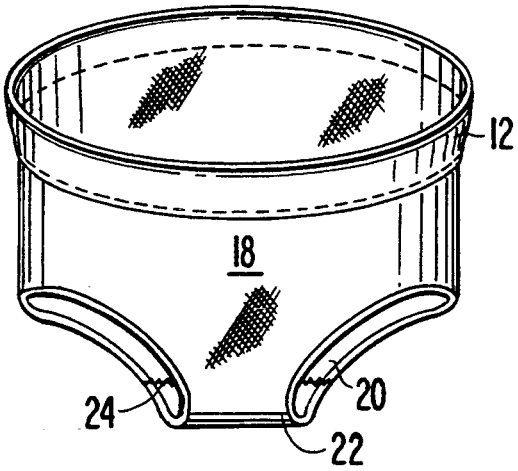
FIG. 4 is a frontal view of the assembled garment of the invention.

FIGS. 3 and 5 are frontal and posterior views of the garment blank prior to the final assembly thereof, FIGS. 4 and 6 being frontal and posterior views of the assembled garment after the operation of stitching-in the free end of the crotch portion 22 to the lower edge of the posterior portion 20, the same reference numerals having been used in FIGS. 3–6 as those used in FIGS. 1 and 2.

FIG. 7 is illustrative of a formed garment according to the present invention when positioned on the body of a wearer, the frontal panel 18 overlying the wearer's abdomen, the posterior panel 20 overlying the wearer's buttocks, the crotch portion 22 extending between the wearer's legs and being secured to the lower edge of the posterior panel 20 at the location 24, the location 24 being closely proximate to the upper of the leg of the wearer, and, positioned in line with the wearer's gluteal crease, in which position it constitutes minimal discomfort to the wearer when the wearer is either standing, walking or sitting.

The finished garment exhibits exceptional comfort and exceptional lack of irritation to the wearer, this being greatly in excess of the extent of comfort and freedom from irritation of prior known garments. The garment of the present invention, to the greatest possible extent, moves in unison with the wearer's skin, thus eliminating dragging, ruckling or puckering and twisting of the garment relative to the movements of the user's skin.

The dominant reasons for the enhanced comfort of the garment are believed to reside in three dominant areas, the first being the elimination from the waistband of elastic bands, and the formation of the waistband in such a manner that it is tri-directionally stretchable. The other dominant reason is believed to reside in the tri-directional stretchability in the body of the garment itself. The third dominant reason is believed to reside in the tri-directional stretchability of the crotch portion with the elimination of any frontal seaming of the crotch portion, and, in the positioning of the single seam of the garment in the plane of the wearer's gluteal crease.

Provided that these parameters are retained in the manufacture of the garment, then, wide scope exists in the selection of appropriate yarns and elastic monofilaments to be employed in the knitting of the garment, and, also in the actual stitch pattern employed in the waistband, body portion and crotch portion. Those possibilities extend to the incorporation of patterning into selected portions of the garment, to the weight or elasticity of the elastic monofilaments, and, to the extent to which the garment is sized and set subsequent to assembly of the garment.

What is claimed is:

1. An undergarment constructed of a unitary garment blank that has been knit in a single piece including:

a welted waistband portion;

a seamless body portion formed integrally with said waistband portion and extending below said waistband portion, said body portion including a front section adapted to overlie the abdomen of the wearer, upper thigh sections adapted to encircle the thighs of a wearer, and a rear section adapted to overlie the buttock areas of a wearer; and, a crotch closure section formed integrally with said front section;

said crotch section having a single thickness which is stretchable in a first direction along an axis extending from said front section to said rear section; is stretchable in a second direction extending at right angles to said first direction; and also, is stretchable in third directions angularly disposed to said first and second directions;

the stretch in said second and third directions being greater than the stretch in said first direction, and, said crotch section extending downwards from a lower portion of said front section and being secured by a line of seaming at its opposite end to said rear section of said garment blank at a point substantially aligned with the gluteal crease of the wearer during wearing of said garment;

whereby there is an absence of seaming between said crotch section and said front section of said garment.

2. The undergarment of claim 1, in which said body portion is stretchable in a first direction extending along an axis extending between said front and rear sections, in a second direction extending transverse to said first direction, and also in third directions angularly disposed to said first and second directions, the degree of stretch in said third direction being greater than the degree of stretch in said first and second directions, the degree of stretch in said second direction being greater than the degree of stretch in said first direction.

3. The undergarment of claim 1, in which said waistband is stretchable in a first direction along said axis extending from said front section to said rear section; is of greater stretchability in a second direction extending transverse to said first direction, and, is of greater stretchability than said first and second directions in third directions angularly disposed to said first and second directions.

4. The undergarment of claim 3, in which said waistband is of welted construction, a starting course of the waistband having been knit into a lower course of said garment to provide said welted construction.

* * * * *